US007624554B2

(12) United States Patent
Chae

(10) Patent No.: US 7,624,554 B2
(45) **Date of Patent: *Dec. 1, 2009**

(54) RAIL-TYPE FIXING APPARATUS FOR INSTALLING PANELS

(76) Inventor: Wan S. Chae, Hwain Villa, 301 Nonhyun-dong, Kangnam-Gu, Seoul (KR) 135-812

( * ) Notice: Subject to any disclaimer, the term of this patent is extended or adjusted under 35 U.S.C. 154(b) by 226 days.

This patent is subject to a terminal disclaimer.

(21) Appl. No.: 11/802,265

(22) Filed: May 21, 2007

(65) Prior Publication Data

US 2008/0034697 A1 Feb. 14, 2008

Related U.S. Application Data

(63) Continuation-in-part of application No. 10/516,331, filed on Nov. 30, 2004, now Pat. No. 7,243,470.

(51) Int. Cl.
*E04F 15/02* (2006.01)
*E04B 9/04* (2006.01)

(52) U.S. Cl. ..... 52/480; 52/506.1; 52/573.1

(58) Field of Classification Search ..... 52/403.1, 52/506.05, 578.1, 506.04, 508, 480, 506.01, 52/506.06, 747.1, 747.11, 592.1; 211/162, 211/151; 248/49; 49/410, 411, 425
See application file for complete search history.

(56) References Cited

U.S. PATENT DOCUMENTS 3,210,716 A * 10/1965 Meacham ..... 439/117
4,708,554 A * 11/1987 Howard ..... 411/84
4,856,250 A 8/1989 Gronau et al.
5,224,297 A * 7/1993 Watkins ..... 49/449
5,742,979 A * 4/1998 Garcia-Hernando ..... 16/95 R
6,364,141 B1 4/2002 Ehgott
6,397,543 B1 * 6/2002 Hamar ..... 52/403.1
6,550,206 B2 4/2003 Lee
6,564,522 B1 5/2003 Chiu-Ying (Continued)

FOREIGN PATENT DOCUMENTS

JP 09-125656 5/1997

(Continued)

*Primary Examiner*—Robert J Canfield
*Assistant Examiner*—Christine T Cajilig
(74) *Attorney, Agent, or Firm*—Merek, Blackmon & Voohees LLC; Catherine M. Voorhees

(57) ABSTRACT

A rail type fixing apparatus for installing panels includes a rail 120 having an elongate shape and a plurality of attachment panels 30 inserted into the rail so that they can be moved. The rail 120 has a lower surface 120*a*, a top surface 120*b* on which the panels are placed, and a guide groove 121 spaced a little apart from the inside bottom in the longitudinal direction. The attachment panel 30 is provided with a guide panel 31 extended from the bottom edges thereof so that it is guided by the guide groove 121 to move in the longitudinal direction of the rail 120, and a hook projection 132 formed protruding and perpendicularly with respect to the longitudinal direction from the top surface, the hook projection hooked with and maintained to a first hook groove 4 of the panel 1 and a second hook groove 7 of the other panel 1. An attachment panel 30 and an adjacent attachment panel 30 are applied of the tension restoring force by the elastic member so that the both hook projections 132 close to each other.

8 Claims, 11 Drawing Sheets

U.S. PATENT DOCUMENTS

| | | | |
|---|---|---|---|
| 6,619,000 | B1 | 9/2003 | Chiu-Ying |
| 6,857,242 | B2 | 2/2005 | He |

FOREIGN PATENT DOCUMENTS

| | | |
|---|---|---|
| JP | 11-100978 | 4/1999 |
| JP | 11-159110 | 6/1999 |
| JP | 14-161632 | 6/2002 |
| WO | WO-84/02155 | 6/1984 |
| WO | WO-01/38668 | 5/2001 |

* cited by examiner

Prior Art (A)

Prior Art

RAIL-TYPE FIXING APPARATUS FOR INSTALLING PANELS

The present application is a continuation-in-part application of U.S. patent application Ser. No. 10/516,331, which was filed on Nov. 30, 2004, and is now U.S. Pat. No. 7,243,470.

TECHNICAL FIELD

The present invention relates generally to a method for attaching panels that are, for example, installed on the floors, walls and ceilings of gymnasiums, houses, etc. and to a rail type fixing apparatus for installing the panels. In detail, the present invention relates to a method for attaching panels that do not have defects caused by the expansion and shrinkage of the panels, even though there are no gaps between the panels in consideration of their expansion and shrinkage caused by temperature variations, and that the user can recycle by simply disassembling them without breaking the materials, and to a rail type fixing apparatus for installing the panels.

BACKGROUND ART

Generally, installation panels attached to the floors, walls and ceilings of gymnasiums or houses are made of long, flat cut wood with a certain length, width and depth, and they are attached by inserting, fitting and assembling several panels sequentially.

FIG. 1 is a perspective view showing a general method in which the installation panels are assembled and attached to an attachment surface A. According to the FIG. 1, long wooden supports 100 are arranged at fixed intervals sequentially, and the panels 101 are assembled on the supports 100. At this time, the panels 101 have projections 104, 105 and insertion grooves 102, 103 formed on the long edge and the short edge, are assembled and attached sequentially in an insertion and fitting method using the projections 104, 105 and insertion grooves 102, 103 and are fixed firmly by adhering the panels 101 to the supports 100 using fixing means such as nails or adhesives.

Since the panels 101 are made of wood, they are expanded and shrunk in accordance with the environment of depository or installation, that is, the variations of temperature and humidity. Generally, the total amount of expansion or shrinkage of the panels in the length is not severe, so that there is no defect in that direction. However, the amount of expansion or shrinkage of the panels in the width is severe.

Accordingly, when the panels 101 are shrunk, a gap between the panels widens and a space is formed so that alien substances can be put into the space. Also, it can spoil the beauty of the floor surface. In the case where the panels are expanded, their width widen, so that the panels 101 are stuck fast in the direction of width and accordingly there occurs a projection problem in which any assembled portion of the panels 101 cannot resist the expansion force and the portion rises as shown in FIG. 3(A).

Due to this problem, when making a installation of the inserting and fitting type panels, an extra gap x between panels 101 should be placed assuming that a displacement length caused by expansion of one panel is x. FIG. 2 shows an example of conventional panel attachment method, wherein the case that the extra gap 5x is placed every 5 panels 101, spacers 106 of 5x size should be inserted into every 5 panels and should be removed after finishing the installation.

However, since this conventional method is to make an extra gap in every determined panels 101 and insert the spacers 106 in consideration of the shrinkage and expansion rate of the panels 101, and remove the spacers 106 again after finishing the installation, the assembling work can't be carried out quickly due to the cumbersome work involved and needs an expert with much experience.

In addition, since the expansion or shrinkage rate of the panels 101 just before installation varies in transport procedure and keeping state and temperature/humidity of the place where the panels are installed, it is very difficult for an amateur to determine the extra gap and even the expert often fails to determine the extra gap precisely, and causes defects due to the shrinkage or expansion after installation.

And if many extra gaps are placed when constructing the panels, in case that the line L is drawn on the panels in the gymnasium or other similar place, the line L won't be drawn smoothly due to the extra gaps as shown in FIG. 3(B). So the appearance will not be good.

Also, when we have to remove the attached panels for repair and demolishment, it is difficult to separate the support or panels fixed with nails or strong adhesives, and it even causes a waste of resource and pollution, since the panels are broken and scrapped in the process of removal.

DISCLOSURE OF THE INVENTION

Therefore, the purpose of the present invention is to provide a method and a rail type fixing apparatus for attaching panels, which provides simple and rapid installation even by an amateur, has little defect caused by shrinkage or expansion of the panels due to temperature variations after installation, allows us to separate panels after installation safely so we can recycle them, and allows us to attach panels to the floor, wall and ceiling.

To accomplish this purpose, a first embodiment of the present invention relates to a rail type fixing apparatus adapted to attach long flat shaped panels where each long flat shaped panel has two long and two short edges, a projection and a first hook groove on one side of the long edges, an insertion groove and a second hook groove on the other side of the long edges, the fixing apparatus comprises;

a long shaped rail with a lower surface, which is placed on the attachment surface, an top surface on which a long flat shaped panel is mounted, and a guide groove extending in the longitudinal direction of the rail;

a plurality of attachment panels each having a bottom surface and a top surface, guide panels extending from the bottom surface where the plurality of attachment panels are guided in the guide groove and installed movably in the longitudinal direction of the rail, and has a hook projection extending from the top surface thereof to which a first hook groove of the long flat shaped panel and a second hook groove of a neighboring long flat shaped panel are hooked and maintained, and which is projected in the upper direction and formed in a direction perpendicular to the longitudinal direction of the rail; and an elastic member arranged elastically between an attachment panel and an adjacent attachment panel in order to have respective hook projections of the attachment panel and the adjacent attachment panel drawn toward each other by the elastic restoring force of the elastic member.

In addition, the first and second support grooves are formed in the longitudinal direction on the bottom of the panel, and support projections are formed on the attachment panel in the same direction of the hook projection, into which the first and the second support grooves are inserted.

And, a fixing blade extended from the bottom surface of the rail to the horizontal direction is formed, and a plurality of fixing holes is formed on the fixing blade at a fixed interval.

Further, a second embodiment of the present invention relates to a rail type fixing apparatus adapted to attach long flat shaped panels together where each long flat shaped panel has two long and two short edges, a projection and a first hook groove on one side of the long edges, an insertion groove and a second hook groove on the other side of the long edges, the fixing apparatus comprises;

a long shaped rail with a lower surface, which is placed on an attachment surface, an top surface on which a long flat shaped panel is mounted, and a guide groove located slightly apart from the inside bottom of the rail and extending in the longitudinal direction of the rail;

a plurality of attachment panels each having a bottom surface and a top surface, guide panels extending from the bottom surface where the plurality of attachment panels are guided in the guide groove and installed movably in the longitudinal direction of the rail, and having a hook projection extending from the top surface thereof to which a first hook groove of the long flat shaped panel and a second hook groove of a neighboring long flat shaped panel are hooked and maintained, and which is projected in an upper direction and formed in the a direction perpendicular to the longitudinal direction of the rail; and an elastic member arranged elastically between an attachment panel and an adjacent attachment panel in order to have respective hook projections of the attachment panel and the adjacent attachment panel drawn toward each other by the elastic restoring force of the elastic member;

where the plurality of attachment panels are arranged in a line, without overlapping one another in the rail and adjacent attachment panels are tensioned by the elastic member.

In the rail type fixing apparatus, the rail further comprises a support member at the center of the inside bottom surface thereof.

In the rail type fixing apparatus, it is preferable that the hook projection has a head with a symmetrical rounded cap shape at both ends.

Further, in the rail type fixing apparatus, the attachment panel is preferable to have a cavity at a top surface thereof.

BEST MODE FOR CARRYING OUT THE INVENTION

Now, a preferred embodiment of the present invention will be described with reference to the accompanying drawings.

Figure 1:
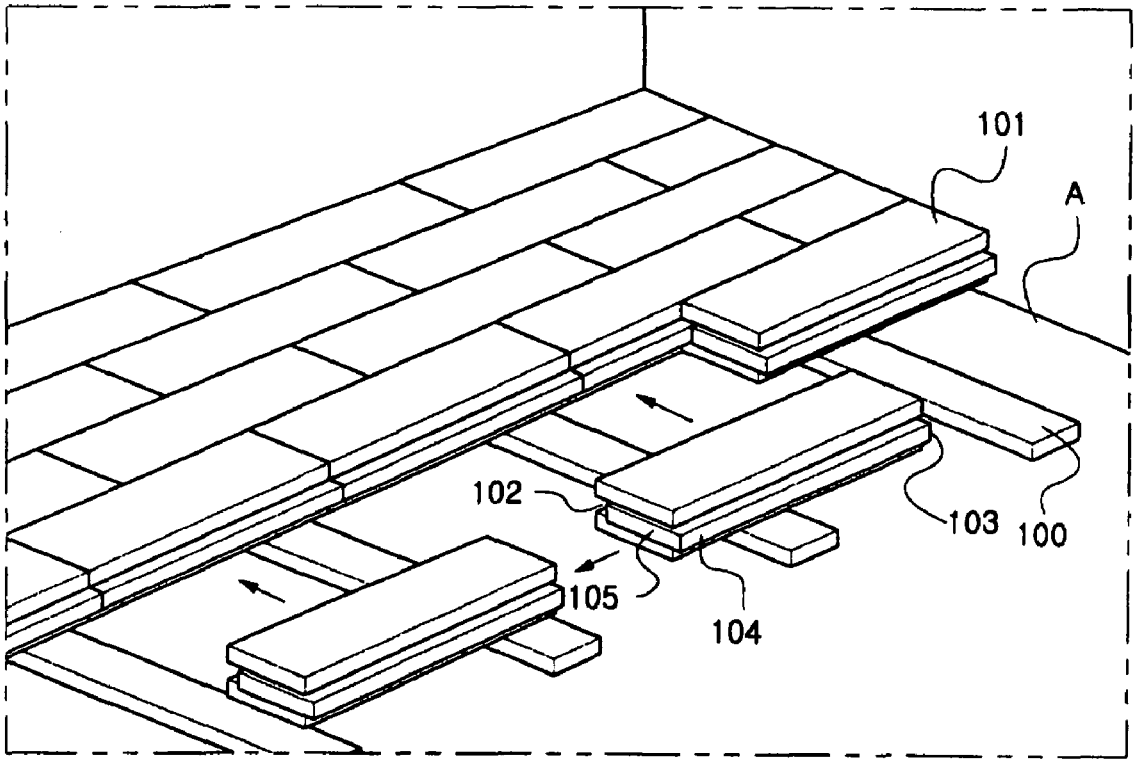
FIG. 1 is a perspective view showing conventional panel attachment method.
Figure 2:
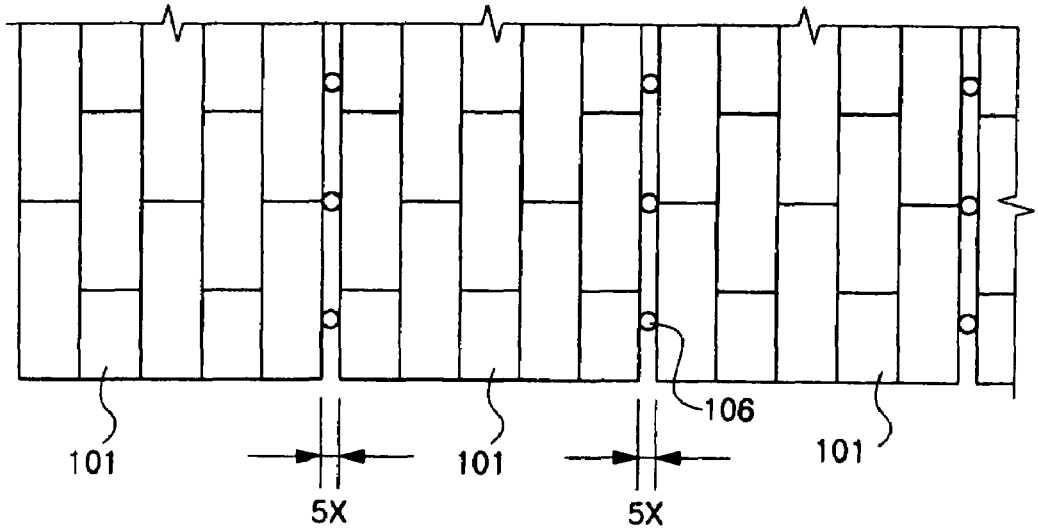
Prior Art FIG. 2
FIG. 2 is a plan view showing conventional panel attachment method.
Figure 3:
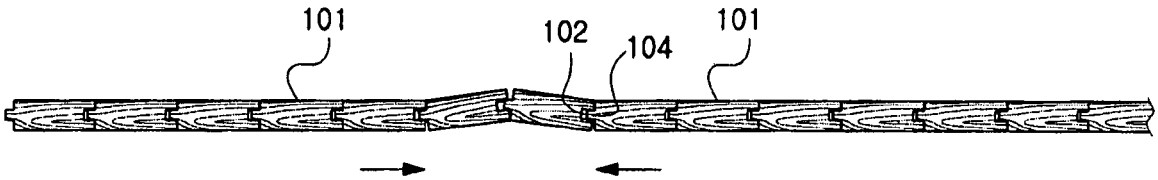
FIGS. 3(A) and 3(B) are a plan and a sectional view showing defections in accordance with the conventional panel attachment method.
Figure 3:
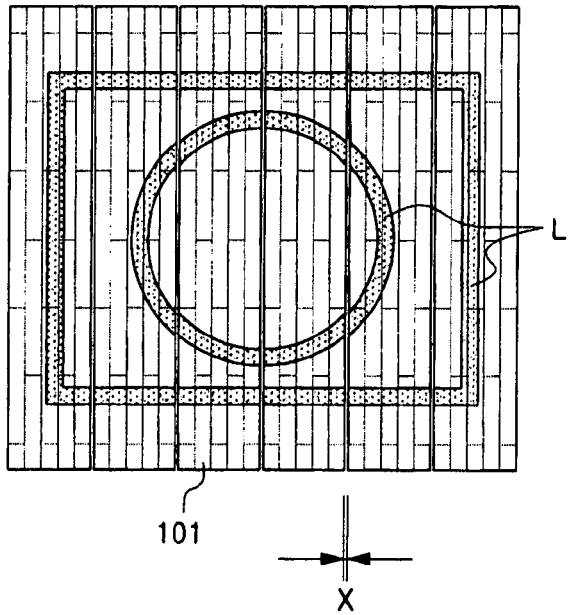
Figure 4:
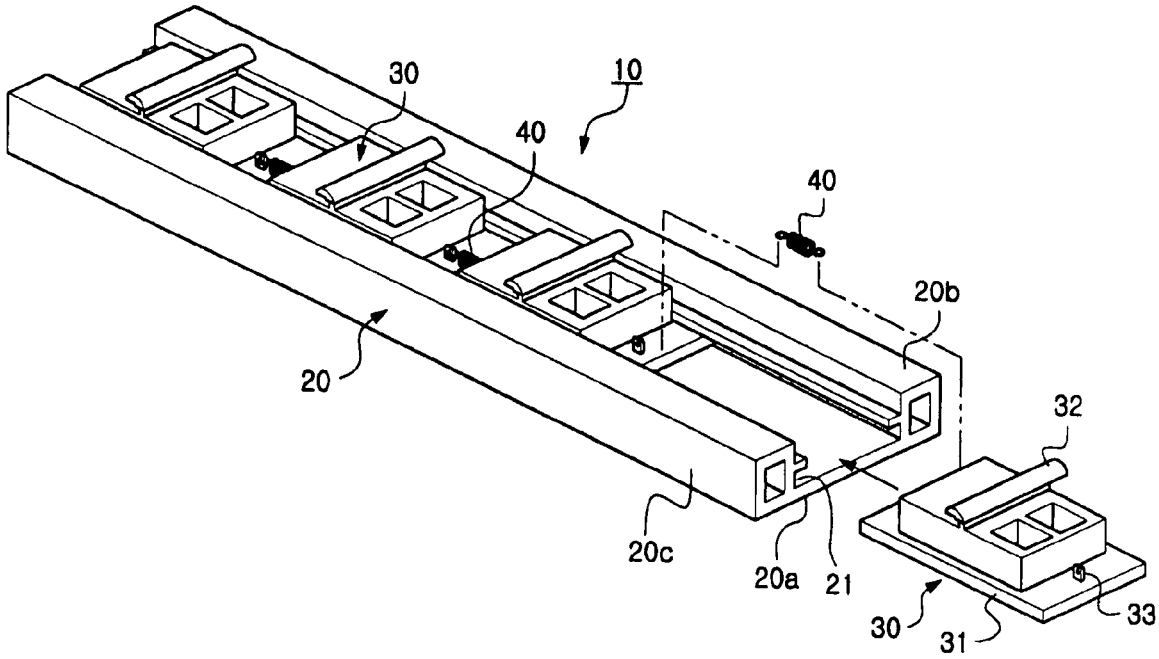
FIG. 4 is a perspective view showing a rail type fixing apparatus for attachment in accordance with a first embodiment of the present invention.
Figure 5:
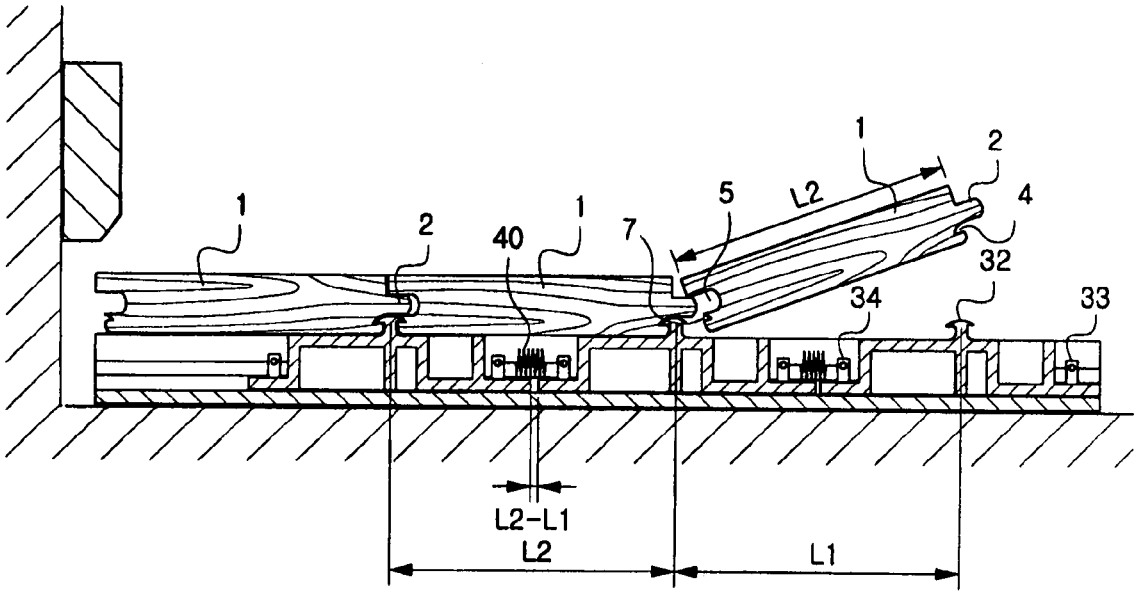
FIG. 5 is a sectional view for explaining the panels attachment method using the rail type fixing apparatus for attachment in accordance with the present invention.
Figure 6:
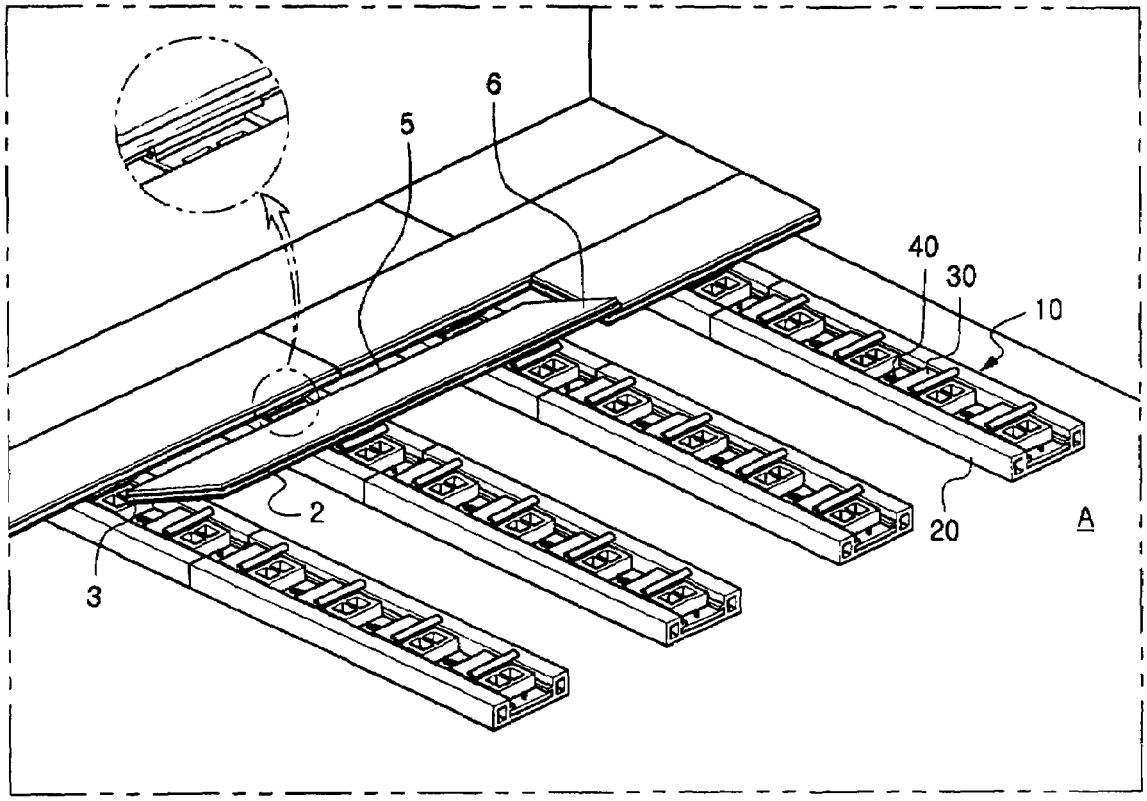
FIG. 6 is an exemplary drawing showing panels attachment method in accordance with the present invention.

FIG. 4 is a perspective view showing the fixing apparatus for attaching the panels to the bottom, wall and ceiling, FIG. 5 is a sectional view for explaining the panel attachment method using the fixing apparatus and FIG. 6 is a perspective view showing the panels attachment method using the fixing apparatus. At first, the panels 1 are generally made of wood and are of a long flat shape with long/short edges.

The panels 1 have projections 2, 3 on each side of long/short edge, and have the first hook groove 4 under the projection of the long edge 2. Also, insertion grooves 5, 6 are formed on the opposite side of long/short edge and the second hook groove 7 is formed under the insertion groove 5 of the long edge.

So, assembling of a panel 1 and another panel 1 is performed by inserting and fitting the projections 2, 3 of one panel 1 into insertion grooves 5, 6 of another panel 1.

The fixing apparatus 10 is to attach the panel 1 to the attachment surface A of the floor, wall and ceiling and consists of a rail 20, a plurality of attachment panels 30 and an elastic member.

The rail 20 is of a long shape, whose section is rectangular. It has a flat bottom surface 20*a* placed on the attachment surface A of the floor, the wall and the ceiling for attaching the panel 1; a flat top surface 20*b* on which the panel 1 is mounted; and a side surface 20*c* of a predetermined thickness for maintaining the panel 1 in a fixed interval from the attachment surface A.

Also, the rail 20 forms a path opened to the upper part from the central part and guide grooves 21 are formed on both opposite inner walls in the lower part of the path in the longitudinal direction of the rail. A plurality of attachment panels 30 is movably installed in the guide groove 21 in the longitudinal direction of the rail 20.

The attachment panel 30 is formed of a flat shape and has guide panels 31 in both edges of their lower part, which are inserted to the guide groove 21 and guided. The attachment panel 30 has a hook projection 32 projecting in the upper direction from its top surface, and the projection 32 is formed in the rectangular direction to the longitudinal direction of the rail. The first hook groove 4 of the panel 1 and the second hook groove 7 of another panel 1 assembled with the panel 1 are hooked and maintained on both sides of the hook projection 32.

When a plurality of the attachment panels 30 is installed in the rail 20, the length L1 between a hook projection 21 and an adjacent hook projection 32 in the state that one attachment panel 30 is in contact with an adjacent attachment panel 30 is set to be less than the length L2 between the first hook groove 4 and the second hook groove 7 of the panel 1.

Preferably, the top surface of the hook projection 32 is formed with a curved surface and makes the hook maintaining operation of the first and the second hook grooves 4, 7 of the panel 1 easy.

The elastic member is installed between one attachment panel 30 and an adjacent attachment panel 30, and operates the elastic restoring force into the direction that both hook projections 32 draw each other. For example, in the case where the elastic member is a tension coil spring 40, as shown in FIGS. 4 and 5, the first and the second hook rings 33, 34 are formed on both sides of the hook projection 32 of the attachment panel 30 on their top surfaces so that one end of the tension coil spring is hooked on the first hook ring 33 and the other end is hooked on the second hook ring 34 of the adjacent attachment panel.

The elastic member is not limited to the tension coil spring 40. For example, tension members such as a compression coil spring, a panel spring or torsion spring can be used, if the tension restoring force acts into the direction to draw the hook projection 32 of the attachment panel 30 each other.

Even though one tension member is shown in FIG. 4, it is not limited to that and the number of the tension member can be varied and the required height between the attachment surface A and the panel 1 can be simply determined as the side 20*c* of the rail 20.

Referring to FIGS. 5 and 6, it will be described how to attach the panel to the attachment surface with fitting in accordance with the present invention.

At first, fixing apparatuses 10 are arranged on the attachment surface A in a plurality of row spaced in a fixed distance in the direction of their width. Here, the spaced distance should be shorter than the length of the panel 1. The panel 1 attached for the first time is installed with a extra gap from the wall surface and the first hook groove 4 is inserted and fitted into the hook projection 32.

Then, in the case that the panel 1 is assembled sequentially, the insertion groove 5 is inclined slightly and inserted into the projection part 2 of the panel 1 which was assembled, and the second hook groove 7 is inserted and fitted in the hook projection 32, and the hook groove 4 is inserted into the hook projection 32 in the opposite side. Since the top surface of the hook projection 32 is a curved surface, the insertion and fitting operation of the first hook groove 4 can be performed easily.

By being assembled sequentially in this way, the panel 1 can be assembled and attached on the rail 20 and the attachment panel 30 simply and rapidly.

Since the length L1 between hook projections 32 is set shorter than the distance L2 between the first hook groove 4 and the second hook groove 7 of the panel 1, when the first hook groove 7 is inserted and fitted in the hook projection 32, the gap between one attachment panel 30 and the adjacent attachment panel 30 is spaced and then the distance between the hook projections 32 is lengthened by L2-L1, so that the resulting distance will become identical with the distance L2 between the first hook groove 4 and the second hook groove 7 of the panel 1. Accordingly, the tension coil spring 40 is tensioned for that, and one attachment panel 30 and the adjacent attachment panel 30 draw each other by the tension restoring force of the tension coil spring 40 so that the panel 1 is firmly inserted between both the hook projection 32 and fixed in the fixing apparatus 10.

If the fixing apparatus 10 is sequentially arranged in the longitudinal direction and assembled sequentially using this method, the panel 1 can be attached simply and rapidly, and the attached panels 1 are stuck fast elastically by the elastic restoring force of the tensioned tension coil spring 40, so that the panels maintain a fixed state firmly as a whole and do not rise or separate from the attachment surface A.

Figure 7:
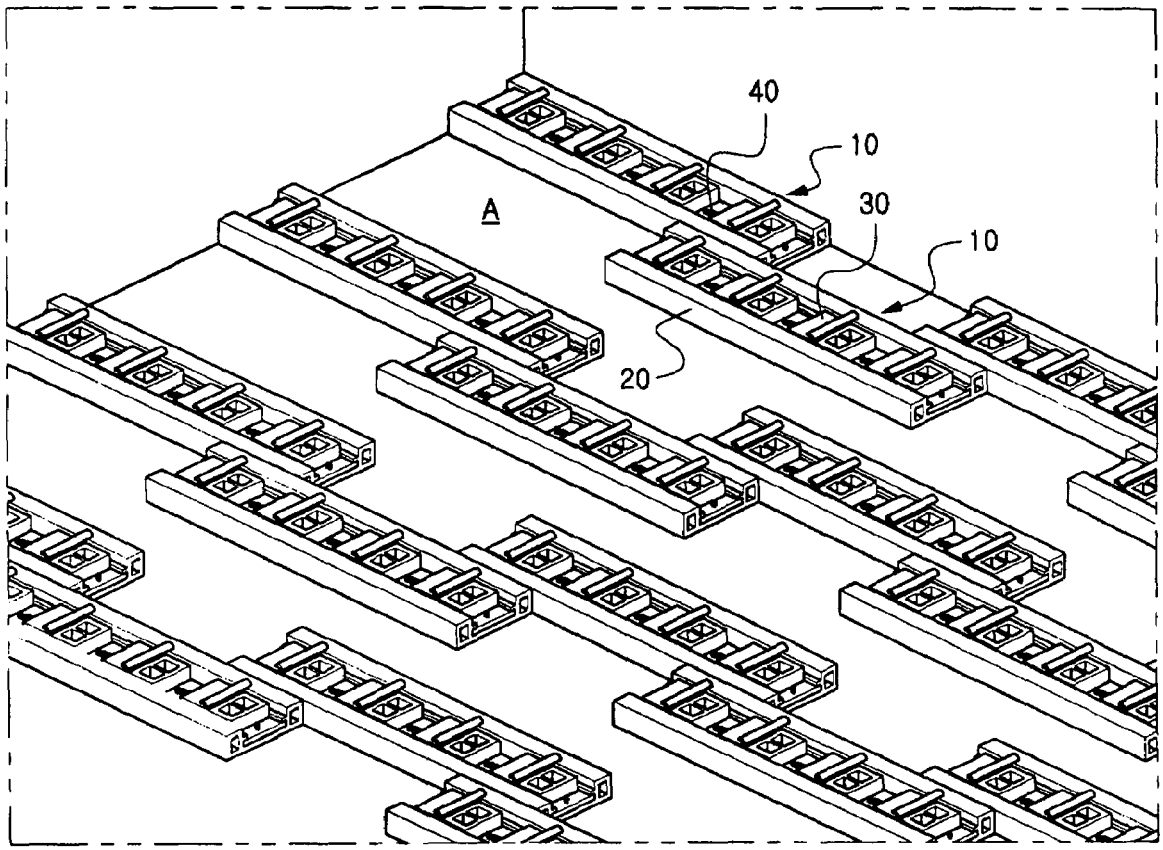
FIG. 7 is an exemplary drawing showing panel attachment method in accordance with the present invention.

Also, FIG. 7 shows another arrangement of the fitting. When the fixing apparatuses 10 are sequentially arranged in the longitudinal direction, the some end part of them can be overlapped and other various arrangement of the fitting can be performed in order to attach the panel to the attachment surface.

In case the panel 1 is shrunk or expanded by temperature variations in accordance with the season or the environment, the tension member can absorb the deformation, and the defects due to the shrinkage and expansion can be prevented.

That is, when the panel 1 is constricted in the direction of width by the variation of the temperature and humidity in the installation place, both hook projections 32 can be drawn as much as the shrinkage by the tension restoring force of the tension coil spring 40, and the tension coil spring 40 can be extended when the panel 1 is expanded. Accordingly, since the tension member can absorb the expansion or the shrinkage of the panel 1 and the connection parts of the panel 1 are always stuck fast by the tension restoring force, it is not necessary to form spaces per every fixed distance like the conventional panel attachment method.

Accordingly, since there is no need to make a space per every fixed distance, even an amateur can install the panel. Also, since it is not necessary to insert spacers into the space and remove them after finishing the installation, the installation of the panel 1 is performed more simply and rapidly.

Moreover, defects after the installation occurred by setting the spacer erroneously, that is, gaps between the panels in the case where the panel is shrunk or projections occurred by an expansion force when the panel is expanded can be prevented. Also, when drawing lines on the surface of the panel 1, removing the gap between the panels can draw smooth lines without disconnection, and so the good appearance can be accomplished.

Figure 8:
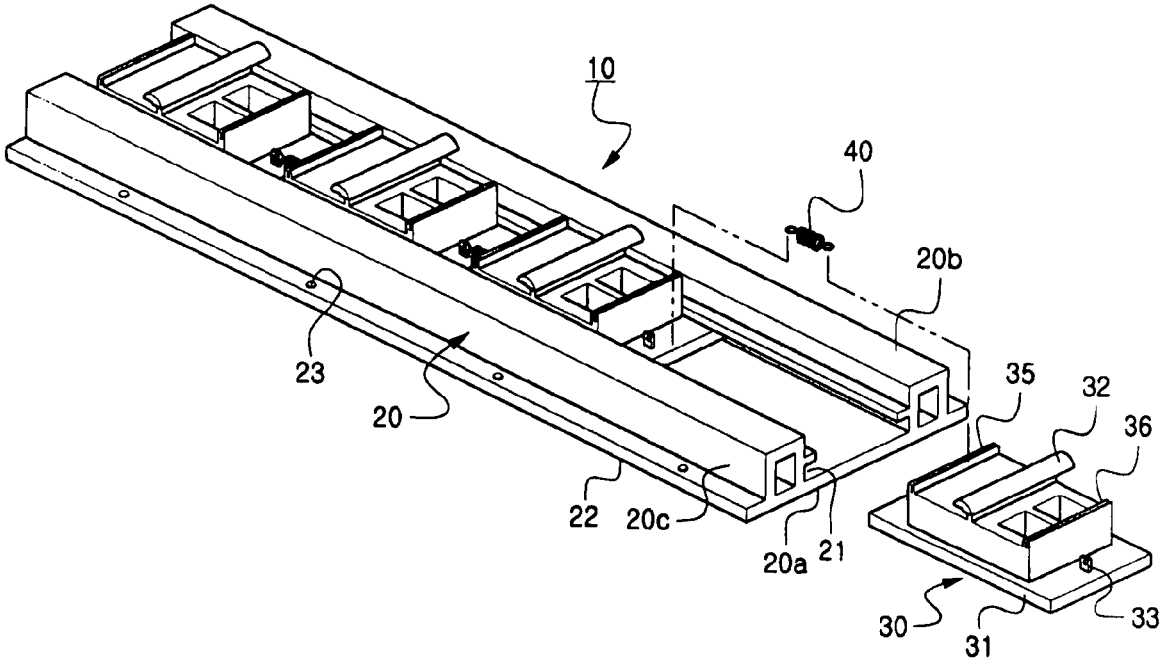
FIG. 8 is a perspective view showing another embodiment of a rail type fixing apparatus for attachment in accordance with the present invention.
Figure 9:
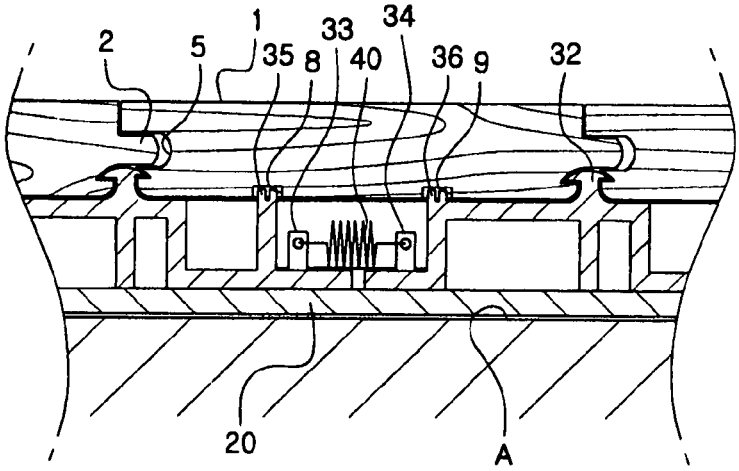
FIG. 9 is a sectional view showing a state of the panels installed using the rail type fixing apparatus for attachment of the embodiment shown in FIG. 8.
Figure 10:
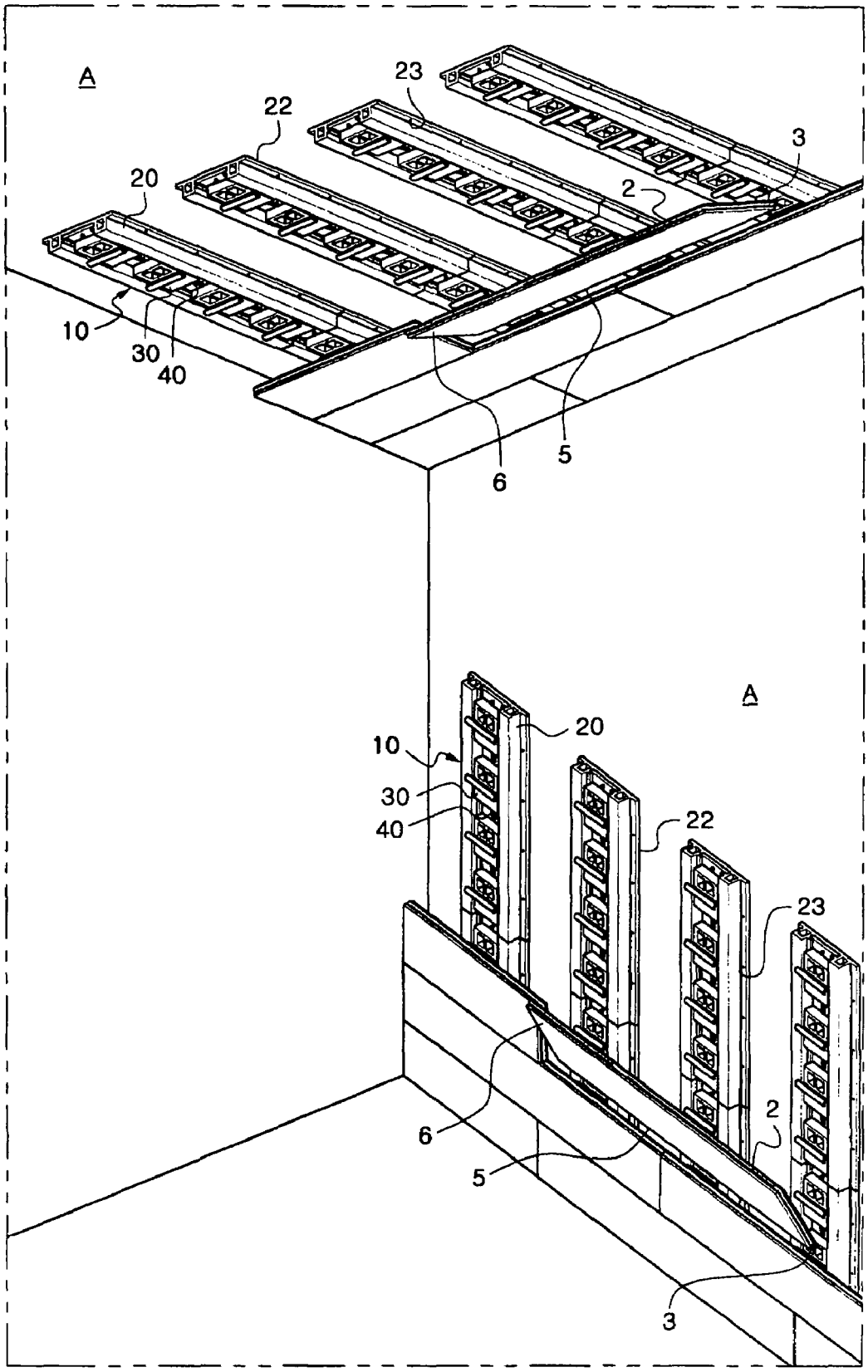
FIG. 10 is a perspective view showing a state of panels installed on the ceiling and wall surfaces using the rail type fixing apparatus of the embodiment shown in FIG. 8.

FIGS. 8 and 9 show another embodiment of the present invention. This embodiment is identical with the embodiment described above, except that the first and the second support grooves 8, 9 are formed in the longitudinal direction on the bottom surface of the panel of the above embodiment; support projections 35, 36 which are inserted into the first support groove 8 and the second support groove 9 are formed on the attachment panel 30 in the same direction as the hook projection 32; and that the rail 20 has fixing blades 22 which are extended from the bottom of the rail in the horizontal direction; and a plurality of fixing holes 23 is formed on the fixing blade 23 at a fixed interval.

According to this constitution, the panel 1 is further supported by the first and second support grooves 35, 36 formed on the attachment panel 30, as shown in FIG. 9. Where the panel 1 is attached to the wall surface or the ceiling surface with the fixing blades 22, the rail 20 is fixed on the wall surface or the ceiling surface with fittings such as nails, and then the panel 1 is assembled and attached with the same method as the embodiment described above. Thus, since the hook projection 32 formed on the attachment panel 30 of the fixing apparatus 10 sticks and fixes the panel 1 by the elastic restoring force of the tension member, the panel can be firmly attached without rising or prating from the wall or the ceiling.

Hereinafter, the second and third embodiments of the rail type fixing apparatus of the present invention will be described.

Figure 11:
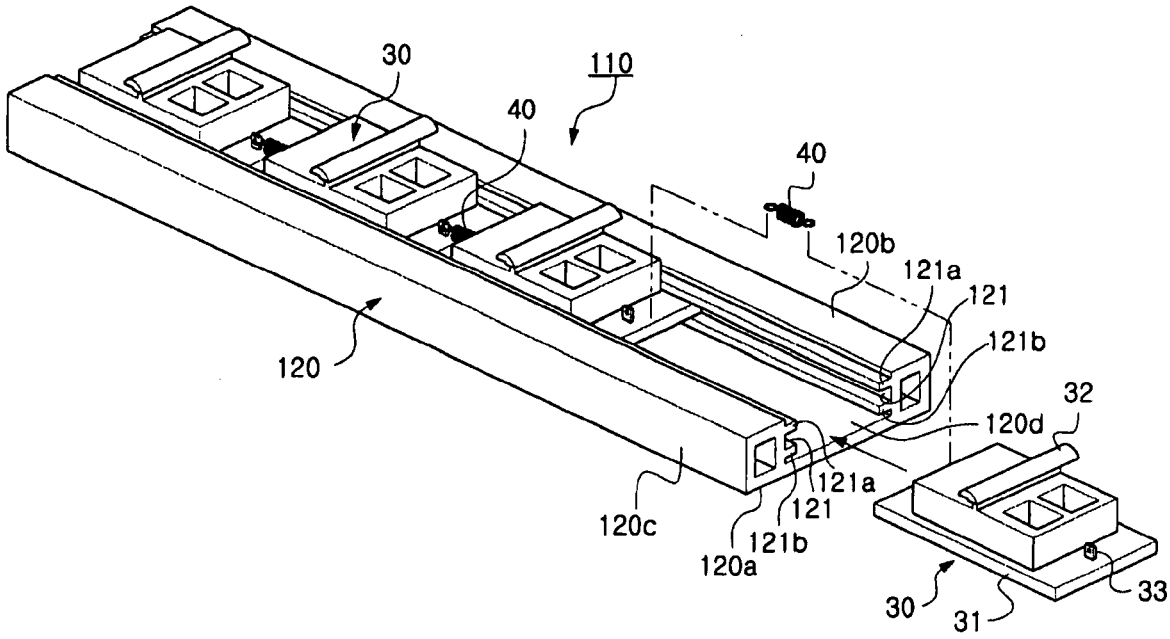
FIG. 11 is a perspective view showing a rail type fixing apparatus for attachment in accordance with a second embodiment of the present invention.

FIG. 11 is a perspective view showing a rail type fixing apparatus in accordance with a second embodiment of the present invention. Referring to FIG. 11, while the rail type fixing apparatus 110 according to the second embodiment is the same as the rail type fixing apparatus 10 of the first embodiment, the rail type fixing apparatus 110 of the second embodiment is different in that a guide groove 121 is formed in a "U" shape with separate guide legs 121*a*, 121*b* from the inside bottom on each side of the rail 120. The reference numerals for the constitutional elements of the fixing apparatus shown in FIG. 11 are obviously denoted to correspond to those shown in FIG. 4, and repeated explanation is omitted for the convenience's sake.

As was the first embodiment, the rail 120 is formed into a long rectangular section, and comprises a flat lower surface 120*a* placed on an attachment surface A, such as a bottom, a wall, a ceiling, and the like; a flat top surface 120*b* on which the panel 1 is placed, and a side surface 120*c* with a desired thickness for maintaining a predetermined interval between the panel 1 and the attachment surface A for attaching the panel 1. Also, the rail 120 is provided with a path, which is opened from the center portion of flat lower surface 120*a* to top surface 120*b* so that two top surfaces 120*b* separated by the opening are formed. In addition, the guide grooves 121 of rail 120 are formed at both lower, opposing inner wall surfaces of the path in the longitudinal direction. However, the guide groove 121 is a little spaced from the inner bottom surface 120*d* of the rail 120 in the second embodiment. The guide groove 121 is formed at the inside inner wall of the rail 120 by an upper guide member or guide leg 121*a* and a lower guide member or guide leg 121*b*. As a result, since the friction between the attachment panel 30 and the rail 120 is small in comparison with the rail type fixing apparatus 10 of the first embodiment, the attachment panel 30 can be moved more freely. Accordingly, although foreign materials, such as dirt, may remain in the inside bottom surface of the rail 120, a plurality of attachment panels 30 can be guided and moved along the guide grooves 121 more easily in the longitudinal direction of the rail 120. In addition, even when the attachment surface A is not smooth, the attachment panel 30 can be easily guided along the guide groove 121.

Figure 12:
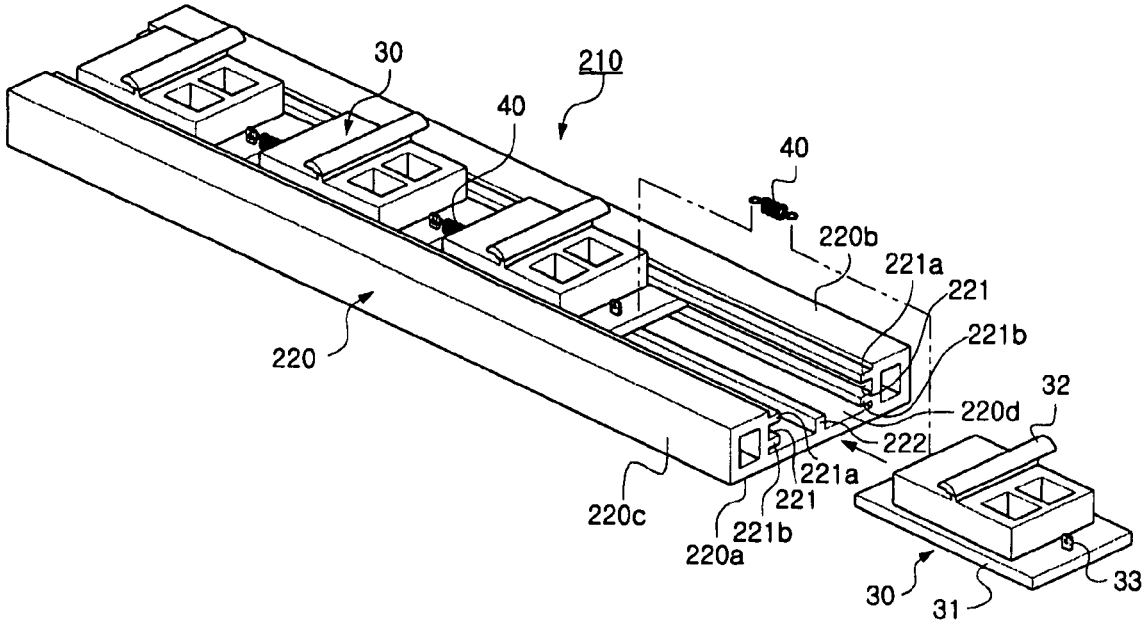
FIG. 12 is a perspective view showing a rail type fixing apparatus for attachment in accordance with a third embodiment of the present invention.
Figure 13:
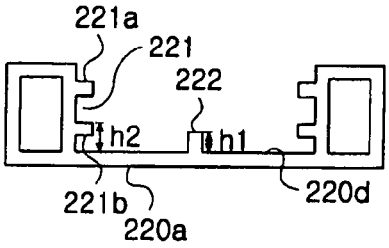
FIG. 13 is a side view showing the rail of FIG. 12.

FIG. 12 is a perspective view showing a rail type fixing apparatus for attachment in accordance with a third embodiment of the present invention, and FIG. 13 is a side view showing the rail of FIG. 12. Referring now to FIGS. 12 and 13, while the rail type fixing apparatus 210 according to the third embodiment is the same as the rail type fixing apparatus 110 of the second embodiment, the rail type fixing apparatus 210 of the third embodiment is different that a support member 222 is disposed at the center of the inside bottom surface 220*d* of the rail 220. A height h1 of the support member 222 is preferable to be lower or identical with an installation height h2 of the guide groove 221 from the inside bottom surface 220*d*. Since the rail 220 is provided with the support member 222 in the rail type fixing apparatus 210 of the third embodiment of the present invention, it is stronger because the support member can endure the load applied to the attachment panel 30 when the attachment panel 30 is guided along the guide groove 221. Also, since the fixing apparatus 210 of the third embodiment of the present invention is provided with the support member 220 at the center of the inside bottom of the rail 220 in the fixing apparatus 210 of the present embodiment, it is more difficult for large foreign materials to be introduced into the path of the rail 220 in comparison with the fixing apparatus 110 of the second embodiment.

Figure 14:
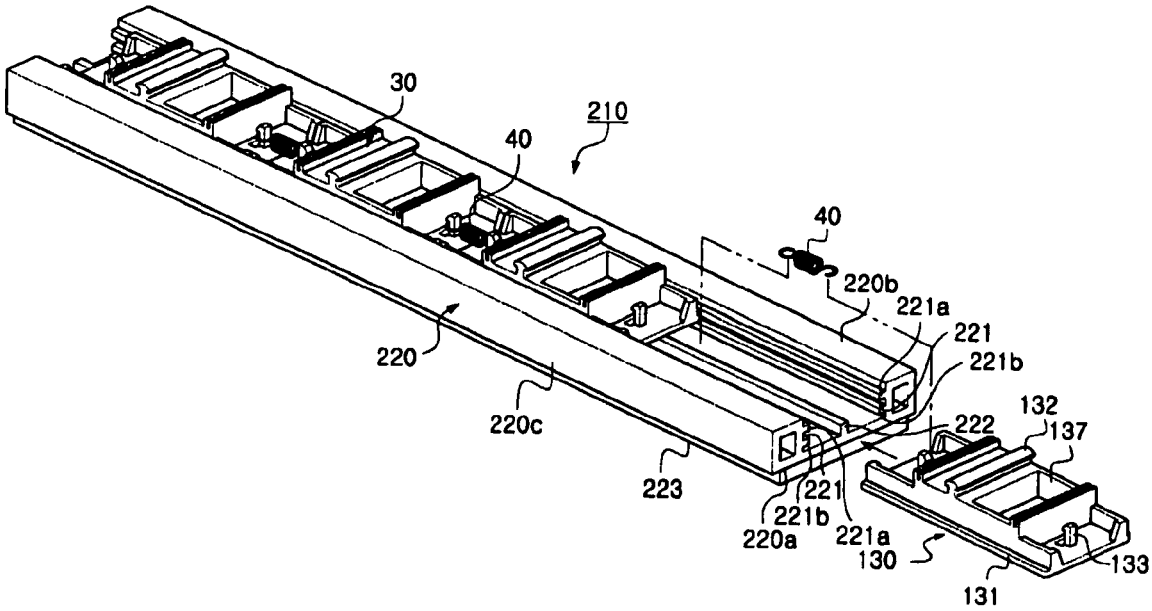
FIG. 14 is a perspective view showing a rail type fixing apparatus for attachment in accordance with the third embodiment of the present invention, which is constructed by providing another attachment panel to the rail type fixing apparatus of the second embodiment.
Figure 15:
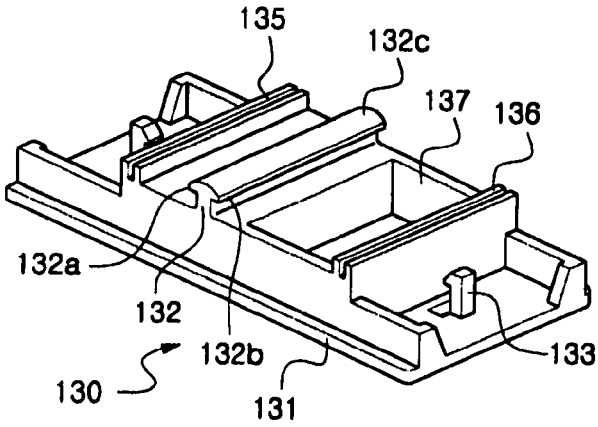
FIG. 15 is a detailed perspective view of another attachment panel shown in FIG. 14.

FIG. 14 is a perspective view showing a rail type fixing apparatus for attachment in accordance with a third embodiment of the present invention, which is constructed by providing another attachment panel 130 to the rail type fixing apparatus of the second embodiment, and FIG. 15 is a detailed perspective view of another attachment panel 130 shown in FIG. 14.

Referring to FIG. 14 and FIG. 15, an attachment panel 130, similar to the attachment panel 30 shown in FIG. 8, is formed into a panel shape, is provided with a guide panel 131 which can be inserted into guide grooves 221 and is formed at both lower edge portions of attachment panel 130. A hook projection 132 is formed protruding in the upward direction from the top surface of the attachment 130. The hook projection 132 is formed to be perpendicular with respect to the longitudinal direction of the rail 220, so that it can be hooked with a first hook groove 4 of the panel 1 and a second hook groove 7 of the other panel 1 assembled to the panel 1 from both sides. In addition, the attachment panel 130 is formed with support projections 135, 136 for inserting a first support groove 8 and a second groove 9 in a direction identical with the hook projection 132.

Figure 16:
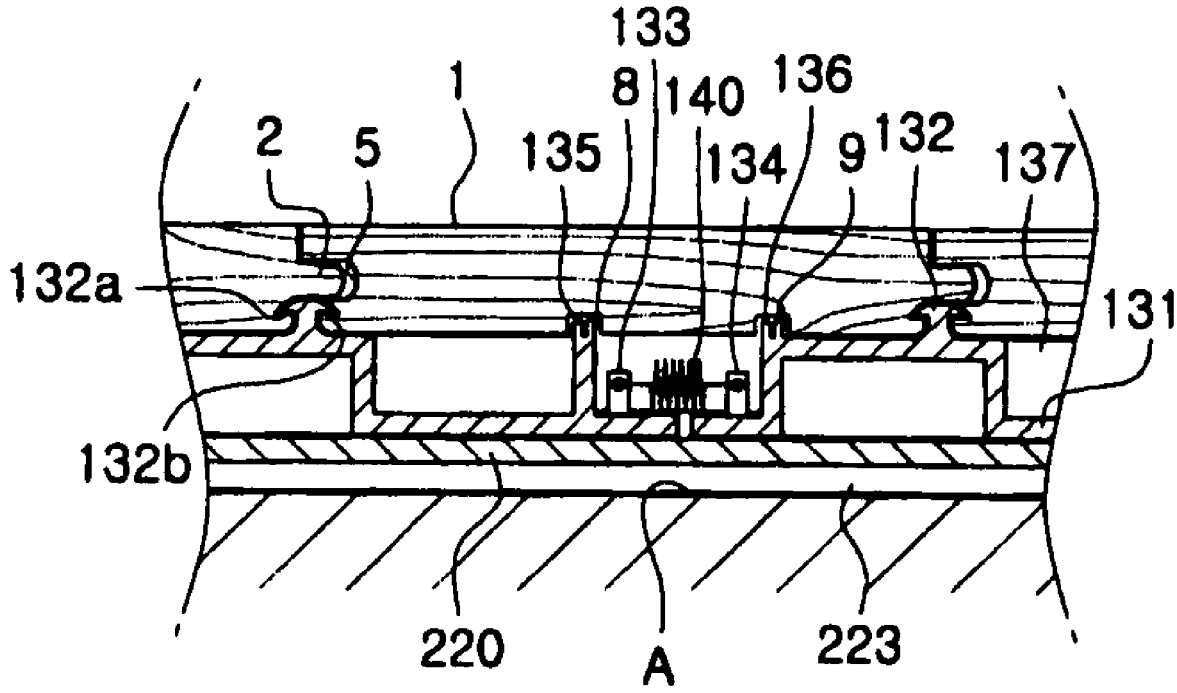
FIG. 16 is a detailed sectional view of a state of installing a panel by using the rail type fixing apparatus in accordance with the third embodiment of the present invention.

However, the hook projection 132 of the attachment panel 130 is provided with a head 132*c* having a shape of a rounded cap that is symmetrical at both distal ends 132*a*, 132*b*. Accordingly, when the panel 1 is inserted into the attachment panel 130, it becomes easier to install the panel 1 because it can be inserted and fitted into the attachment panel 130 from any direction with respect to the hook projection 132 of the one attachment panel 130. FIG. 16 shows a state of installing the panel 1 by using the rail type fixing apparatus 210 according to the third embodiment of the present invention, employing the attachment panel 130. Moreover, as the head 132*c* of the hook projection 132 is formed round to facilitate the hooking and maintaining work of the first and second hook grooves 4, 7 of the panel 1.

Furthermore, the attachment panel 130 can be provided with a cavity 137 on the top surface between the support projection 136 and the hook projection 132 at one side. The cavity 137 acts as a handle to facilitate the insertion and fitting work when the panel 1 is inserted and fitted into the attachment panel 130. In practice, a worker can pull the inside wall of the cavity 137 back with one hand, while the other hand holds the panel 1 so that it can be easier to insert and fit the panel 1 into the attachment panel 130.

According to an attachment method of the panel and a rail type fixing apparatus in accordance with the present invention, the operation of assembling and attaching the panel is performed very simply and rapidly with the fixing apparatus and it is not necessary to set the space when assembling the panels, so that even amateurs can perform the installation. Also, the present invention is very economical, since the labor cost and working hours can be reduced sharply.

Also, when the panel is shrunk or expanded in accordance with temperature variations after attachment of the panel, the deformation can be absorbed by the fixing apparatus, which is expanded and shrunk using the elastic member, so that there is no defect in accordance with temperature variations after the installation of the panel. In addition, since materials can be reused due to the fact that the panels can be separated without breaking them. Resources can be saved and pollution of the environment can be prevented.

Also, the panels can be attached to the wall and the ceiling simply and rapidly by fixing the rail of the fixing apparatus to the wall and the ceiling.

What is claimed is:

1. A rail type fixing apparatus adapted to attach long flat shaped panels together where each long flat shaped panel has two long and two short edges, a projection and a first hook groove on one side of the long edges, an insertion groove and a second hook groove on the other side of the long edges, the fixing apparatus comprises;

a long shaped rail with a lower surface, which is placed on an attachment surface, an top surface on which a long flat shaped panel is mounted, and a guide groove located slightly apart from the inside bottom of the rail and extending in the longitudinal direction of the rail;

a plurality of attachment panels each having a bottom surface and a top surface, guide panels extending from the bottom surface where the plurality of attachment panels are guided in the guide groove and installed movably in the longitudinal direction of the rail, and having a hook projection extending from the top surface thereof to which a first hook groove of the long flat shaped panel and a second hook groove of a neighboring long flat shaped panel are hooked and maintained, and which is projected in an upper direction and formed in the a direction perpendicular to the longitudinal direction of the rail; and an elastic member arranged elastically between an attachment panel and an adjacent attachment panel in order to have respective hook projections of the attachment panel and the adjacent attachment panel drawn toward each other by the elastic restoring force of the elastic member;

where the plurality of attachment panels are arranged in a line, without overlapping one another in the rail and adjacent attachment panels are tensioned by the elastic member.

2. The rail type fixing apparatus according to claim 1, wherein the guide groove of the rail is formed by an upper guide member and a lower guide member, each of which are provided at an inside wall of the rail, the guide members being spaced apart from the inside bottom surface of the rail.

3. The rail type fixing apparatus according to claim 1, wherein the rail further comprises a support member at the center of the inside bottom surface thereof.

4. The rail type fixing apparatus according to claim 3, wherein the support member has a height identical with or a little lower than an installation height of the guide groove.

5. The rail type fixing apparatus according to claim 1, wherein the hook projection has a head with a symmetrical rounded cap shape at both ends.

6. The rail type fixing apparatus according to claim 1, wherein the attachment panel has a cavity at a top surface thereof.

7. The rail type fixing apparatus according to claim 1, wherein each long flat shaped panel has first and second support grooves that are formed in the longitudinal direction and on the bottom of each of the long flat shaped panels, and each attachment panel further includes support projections formed on the top surface of each of the attachment panels in the same direction of the hook projection so that the support projections are inserted into the first and the second support grooves of a long shaped flat panel when long flat shaped panels are attached to the rail type fixing apparatus.

8. The rail type fixing apparatus according to claim 1, wherein the long shaped rail further includes a fixing blade extending outwardly from the bottom surface of the rail in a direction away from the guide groove and a plurality of fixing holes is formed on the fixing blade at fixed intervals.

* * * * *